US008800103B2

(12) United States Patent
Hong et al.

(10) Patent No.: US 8,800,103 B2
(45) Date of Patent: Aug. 12, 2014

(54) UPRIGHT TYPE CLEANER

(75) Inventors: Seung Gee Hong, Suwon-si (KR); Jae Man Joo, Suwon-si (KR); Myoung Keun Kwon, Seoul (KR); Jun Hwa Lee, Suwon-si (KR); Byoung In Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 656 days.

(21) Appl. No.: 12/395,707

(22) Filed: Mar. 1, 2009

(65) Prior Publication Data

US 2009/0223018 A1 Sep. 10, 2009

Related U.S. Application Data

(60) Provisional application No. 61/064,340, filed on Feb. 28, 2008.

(30) Foreign Application Priority Data

Jul. 10, 2008 (KR) ..... 10-2008-0067156
Feb. 27, 2009 (KR) ..... 10-2009-0016778

(51) Int. Cl.
*A47L 5/00* (2006.01)

(52) U.S. Cl.
USPC ..... 15/323; 15/334

(58) Field of Classification Search
USPC ..... 15/416, 410, 415.1, 334, 331, 323
See application file for complete search history.

(56) References Cited

U.S. PATENT DOCUMENTS

| | | | | |
|---|---|---|---|---|
| 5,125,127 | A * | 6/1992 | Bach et al. | 15/323 |
| 7,203,991 | B2 * | 4/2007 | Stephens et al. | 15/320 |
| 7,213,297 | B2 * | 5/2007 | Nam et al. | 15/334 |
| 2006/0137128 | A1 * | 6/2006 | Elsworthy et al. | 15/323 |

FOREIGN PATENT DOCUMENTS

| | | | | |
|---|---|---|---|---|
| CA | 2514737 | | 2/2006 | |
| DE | 3543376 | A1 * | 6/1987 | A47L 5/32 |
| EP | 1733673 | A2 | 12/2006 | |
| EP | 1733673 | A3 | 8/2007 | |
| GB | 1394497 | | 5/1975 | |
| GB | 2416680 | A | 2/2006 | |
| GB | 2450600 | A | 12/2008 | |
| JP | 2007-089762 | | 4/2007 | |
| KR | 10-2002-0065833 | A | 8/2002 | |
| KR | 10-0608500 | | 7/2006 | |

* cited by examiner

*Primary Examiner* — Dung Van Nguyen
(74) *Attorney, Agent, or Firm* — Staas & Halsey LLP

(57) ABSTRACT

An upright type cleaner in which a mounting structure of a suction device is improved is described. The cleaner includes a base provided with a suction port, a main body connected to the base, and a suction device including a flexible hose extended from the base or the main body, a pipe connected to the flexible hose, and a tool connected to the pipe. The suction device may be fixedly attached to the main body when the tool is mounted on the suction device.

24 Claims, 8 Drawing Sheets

UPRIGHT TYPE CLEANER

CROSS-REFERENCE TO RELATED APPLICATIONS

This application claims the benefit of Korean Patent Application No. 2008-0067156, filed on Jul. 10, 2008, in the Korean Intellectual Property Office, the disclosure of which is incorporated herein by reference. Also, this application claims the benefit of Korean Patent Application No. 2009-0016778, filed on Feb. 27, 2009, in the Korean Intellectual Property Office, the disclosure of which is incorporated herein by reference. Also, this application claims the benefit of U.S. Patent Application No. 61/064,340, filed on Feb. 28, 2008, in the U.S. Patent and Trademark Office, the disclosure of which is incorporated herein by reference.

BACKGROUND

1. Field

One or more embodiments of the present invention relate to an upright type cleaner, and more particularly to a cleaner in which the mounting structure of a suction device is improved.

2. Description of the Related Art

Vacuum cleaners are devices that remove foreign substances such as dust from surfaces. Vacuum cleaners are typically used in homes. Vacuum cleaners suck dust using suction force generated by a blowing device and then filter the dust through a filter. Cleaners are roughly divided into canister type cleaners and upright type cleaners.

Generally, upright-type cleaners include a brush assembly provided with a suction port, a main body rotatably connected to the brush assembly, and a suction device detachably attached to the main body. Here, the suction device includes a flexible hose extended from the main body, a handle connected to the flexible hose, and a pipe connected to the handle.

Conventionally, a user mounts any one of various tools, each of which is suitable for a different task, to a front end of the pipe to clean a ceiling or a narrow gap. The user then separates the tool from the front end of the pipe after cleaning and inserts the front end of the pipe into a cylinder-type support part provided on the main body in order to fix the handle and the pipe to the main body. The tools are then kept in a separately prepared space.

SUMMARY

One or more embodiments of the present invention provide a cleaner in which the mounting performance of a suction device is improved.

Additional aspects and/or advantages will be set forth in part in the description which follows and, in part, will be apparent from the description, or may be learned by practice of the invention.

In accordance with an aspect, the present invention provides an upright type cleaner comprising a base provided with a suction port; a main body connected to the base; and a suction device including a flexible hose extended from the base or the main body, a pipe connected to the flexible hose, and a detachable tool connected to the pipe, wherein the suction device is attached to and detached from the main body under the condition that the tool is mounted on the suction device.

The tool may include a detachable part detachably attached to the pipe, and a housing rotatably connected to the detachable part, and the upright type cleaner may further comprise an anti-rotating unit preventing the rotation of the housing of the tool under the condition that the suction device is mounted on the main body.

The anti-rotating unit may include friction members provided on the main body to apply frictional force to at least a portion of the housing of the tool.

The anti-rotating unit may include a first adhesion part provided on the main body, and a second adhesion part provided on the housing of the tool; and attraction due to magnetic force may be applied between the first adhesion part and the second adhesion part under the condition that the suction device is mounted on the main body, and thus the housing of the tool is attached to the main body.

The suction device may further include a handle easily gripped by a user, and the handle may serve as a handle of the main body under the condition that the suction device is mounted on the main body.

The tool may be an electric tool.

The suction device may further include an electric wire and connection parts electrically connected to the electric tool to supply power to the electric tool when the electric tool is mounted on the suction device.

The upright type cleaner may further comprise a power supply unit provided on the electric tool to supply power to electric parts of the electric tool, a first connection part provided at one side of the electric tool and electrically connected to the power supply unit, and a second connection part provided on the main body to be electrically connected to the first connection part of the electric tool when the suction device is mounted on the main body, and the power supply unit may be charged with power supplied from the main body when the suction device is mounted on the main body.

The upright type cleaner may further comprise a wireless control unit to control the electric tool by wireless, and the wireless control unit may be provided on the handle or the main body.

The suction device may be rotated in one direction in a state supported by the main body, and thus be mounted on the main body.

The upright type cleaner may further comprise a rotary shaft provided on any one of the main body and the suction device; and a rotary groove, into which the rotary shaft is inserted, provided on the other one of the main body and the suction device.

The rotary shaft or the rotary groove provided on the main body may be disposed at the upper portion of the main body.

The upright type cleaner may further comprise a locking hook provided on any one of the main body and the suction device; and a fastening part, to which the locking hook is fastened, provided on the other one of the main body and the suction device, and the locking hook or the fastening part may be elastically supported.

The upright type cleaner may further comprise a release button releasing the fastening between the locking hook and the fastening part to release the suction device from the main body.

The width of the tool may be wider than the width of the pipe of the wand assembly.

The upright type cleaner may further comprise a tool receiving groove provided on the main body to receive the tool of the suction device.

In accordance with another aspect, the present invention provides an upright type cleaner comprising a brush assembly provided with a suction port, a main body connected to the brush assembly, and a suction device extended from the brush assembly or the main body, wherein the suction device is rotated under the condition that a tool is mounted on the front end of the suction device, and thus is mounted on the main body.

The suction device includes a flexible hose extended from the brush assembly or the main body, and a pipe connected to the flexible hose and provided with one end, on which the tool is mounted, wherein the width of the tool is wider than the width of the pipe of the wand The upright type cleaner may further comprise a tool receiving groove provided on the main body to receive the tool of the suction device.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF EMBODIMENTS

Figure 1:
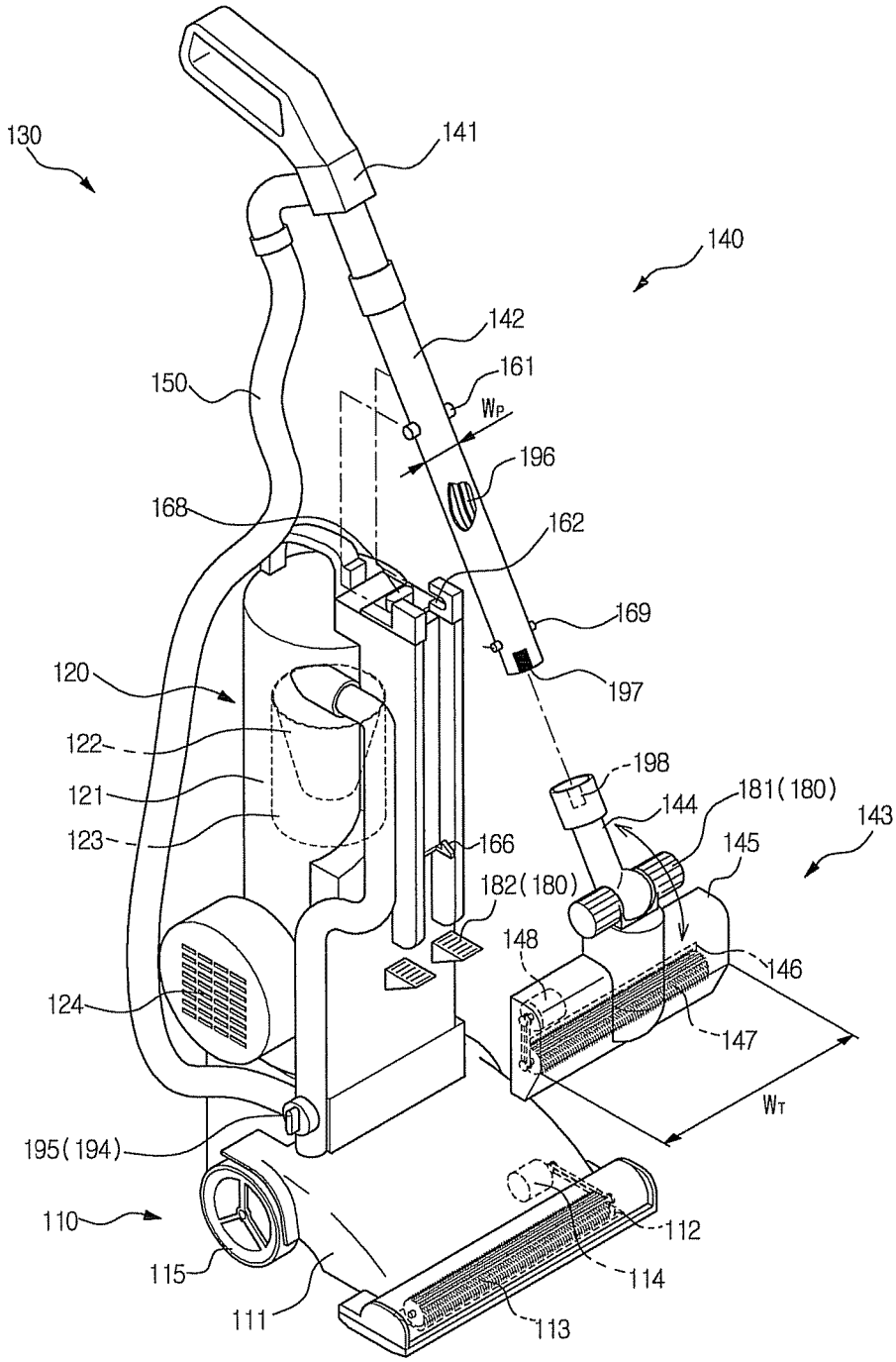
FIG. 1 is a perspective view illustrating the external appearance of an upright type cleaner in accordance with an embodiment of the present invention.

Reference will now be made in detail to embodiments, examples of which are illustrated in the accompanying drawings, wherein like reference numerals refer to the like elements throughout. Embodiments are described below to explain the present invention by referring to the figures.

FIG. 1 is a perspective view illustrating the external appearance of an upright type cleaner in accordance with an embodiment of the present invention.

The cleaner in accordance with an embodiment of the present invention includes a brush assembly 110, a main body 120 rotatably connected to the brush assembly 110, and a suction device 130 detachably attached to the main body 120.

The brush assembly 110 includes a base 111 provided with a suction port 112, a rotary brush 113 accommodated in the base 111 and rotated to brush away dust from a surface to be cleaned and induce the dust inside of the base 111, a driving motor 114 to drive the rotary brush 113, and a plurality of wheels 115 provided at the lower portion of the base 111.

The main body 120 includes a main body casing 121 connected to the base 111 of the brush assembly 110 such that the main body 120 may be rotated, a suction fan (not shown) accommodated in the main body casing 121 to generate suction force, a filter 122 located at the inlet side of the suction fan to filter out foreign substances, and a collection tank 123 provided around the filter 122 to collect the filtered foreign substances. Reference numeral 124 represents an exhaust port through which filtered air is exhausted to the outside.

The suction device 130 includes a wand assembly 140, and a flexible hose 150 extended from the main body 120. The flexible hose 150 is provided with one end connected to the wand assembly 140 to transmit the suction force generated from the suction fan to the wand assembly 140.

The wand assembly 140 may include, for example, a handle 141 easily gripped by a user, and a pipe 142 provided at one side of the handle 141 and connected to the flexible hose 150.

The handle 141 of the wand assembly 140, in accordance with at least this embodiment, may serve as a handle for the main body 120 on the condition that (e.g., when) the suction device 130 is fixed to the main body 120. Specifically, when the wand assembly 140 is locked with the main body 120, the relative motion of the wand assembly 140 with respect to the main body 120 is restricted, and thus a user may use the brush assembly 110 or move the cleaner while the user grips the handle 141 of the wand assembly. The locking structure of the wand assembly 140 will be described below in greater detail.

The wand assembly 140 may further include a tool 143 detachably connected to the front end of the pipe 142.

The tool 143 in an embodiment is driven by electricity. The tool 143 includes a detachable part 144 detachably attached to the pipe 142, a housing 145 rotatably connected to the detachable part 144 and provided with a suction port 146, a rotary brush 147 accommodated in the housing 145 and rotated, and the driving motor 148 to drive the rotary brush 147. On the other hand, as shown in FIG. 1, the tool 143 in accordance with this embodiment is a wide width type tool, the width $W_T$ of which is wider than the width $W_P$ of the pipe 142 of the wand assembly 140, and the wand assembly 140 can be mounted on the main body 120 under the condition that the wide width type tool 143 is mounted on the pipe 142. This mount structure of the wand assembly 140 will be described later.

An electric wire 196 may extend to the flexible hose 150, the handle 141, and the pipe 142 to supply power to electric parts of the tool 143 and to electrically control the electric parts of the tool 143. Reference numerals 197 and 198 represent connection parts provided at the ends of the pipe 142 and the tool 143, respectively. In an embodiment, the electric wire 196 may preferably be buried in the pipe 142 such that the electric wire 196 is not exposed to the outside.

The tool 143 of the suction device 130, in an embodiment, includes the rotary brush 147 driven by the driving motor 148, as described above, and thus brushes away dust from a surface to be cleaned and sucks and removes foreign substances, when a ceiling, a curtain, or a narrow gap is cleaned. Thereby, the cleaning performance of the cleaner is highly enhanced.

Of course, the above-described tool is provided as an example, and thus various other kinds of tools, such as active tools and passive tools, may be mounted on the cleaner as an alternative to the electric tool described.

The cleaner in accordance with an embodiment of the present invention further includes a first channel 191 (not illustrated) provided in the base 111 to transmit the suction force generated from the suction fan to the brush assembly 110, a second channel 192 (not illustrated) provided in the suction device 130 to transmit the suction force generated from the suction fan to the suction device 130, a third channel 193 (not illustrated) provided in the suction fan, and a channel conversion device 194 provided around the intersection of the first, second, and third channels 191, 192, and 193 to selectively communicate the first channel 191 or the second channel 192 with the third channel 193. The channel conversion device 194, in an embodiment, is manipulated by turning a knob 195 by hand, but a separate actuator or a link structure to rotate the knob 195 may also be provided.

Figure 2:
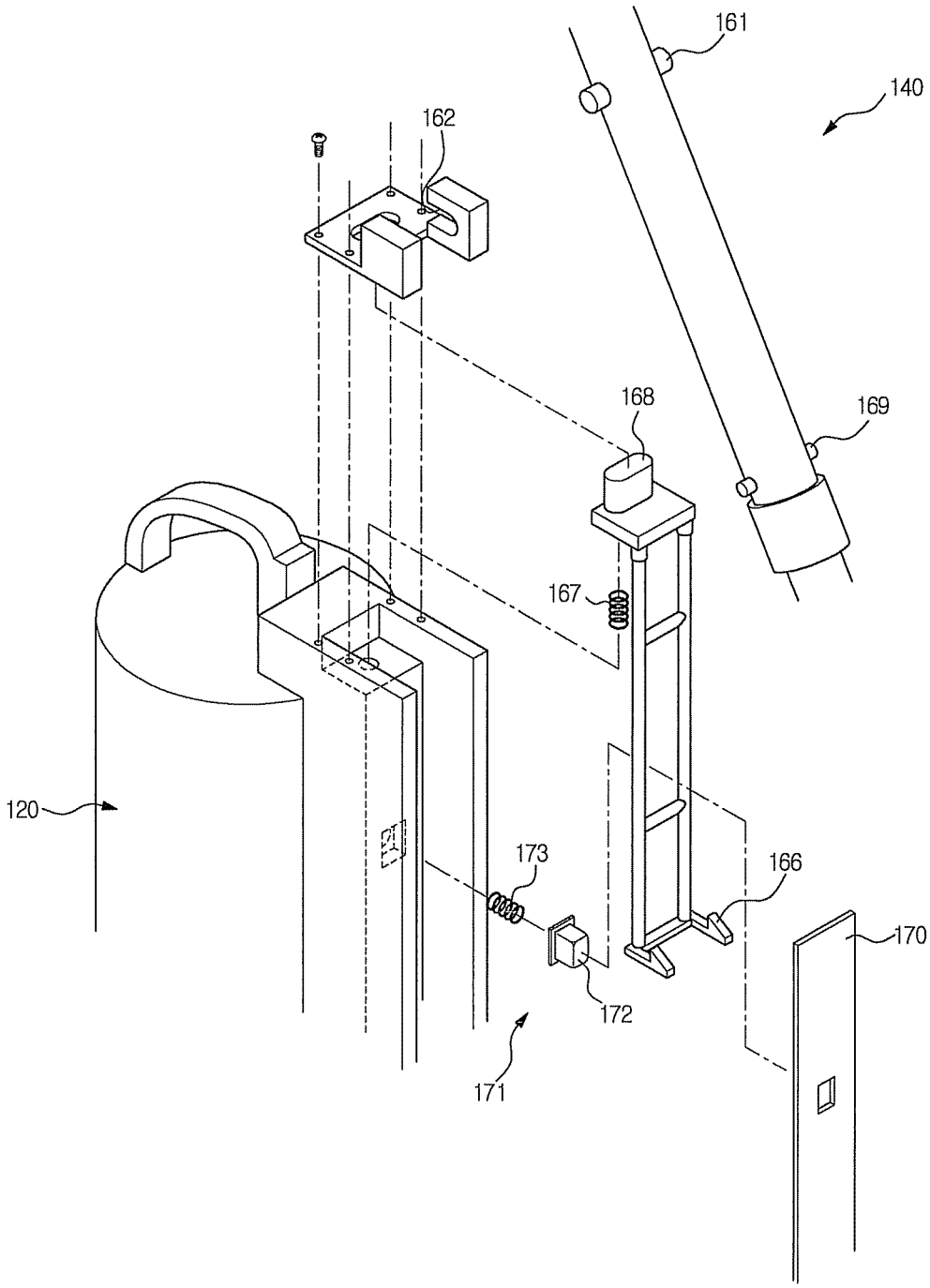
FIGS. 2 and 3 are respectively exploded perspective and longitudinal-sectional views illustrating a fixing part of a suction device in accordance with an embodiment of the present invention.
Figure 3:
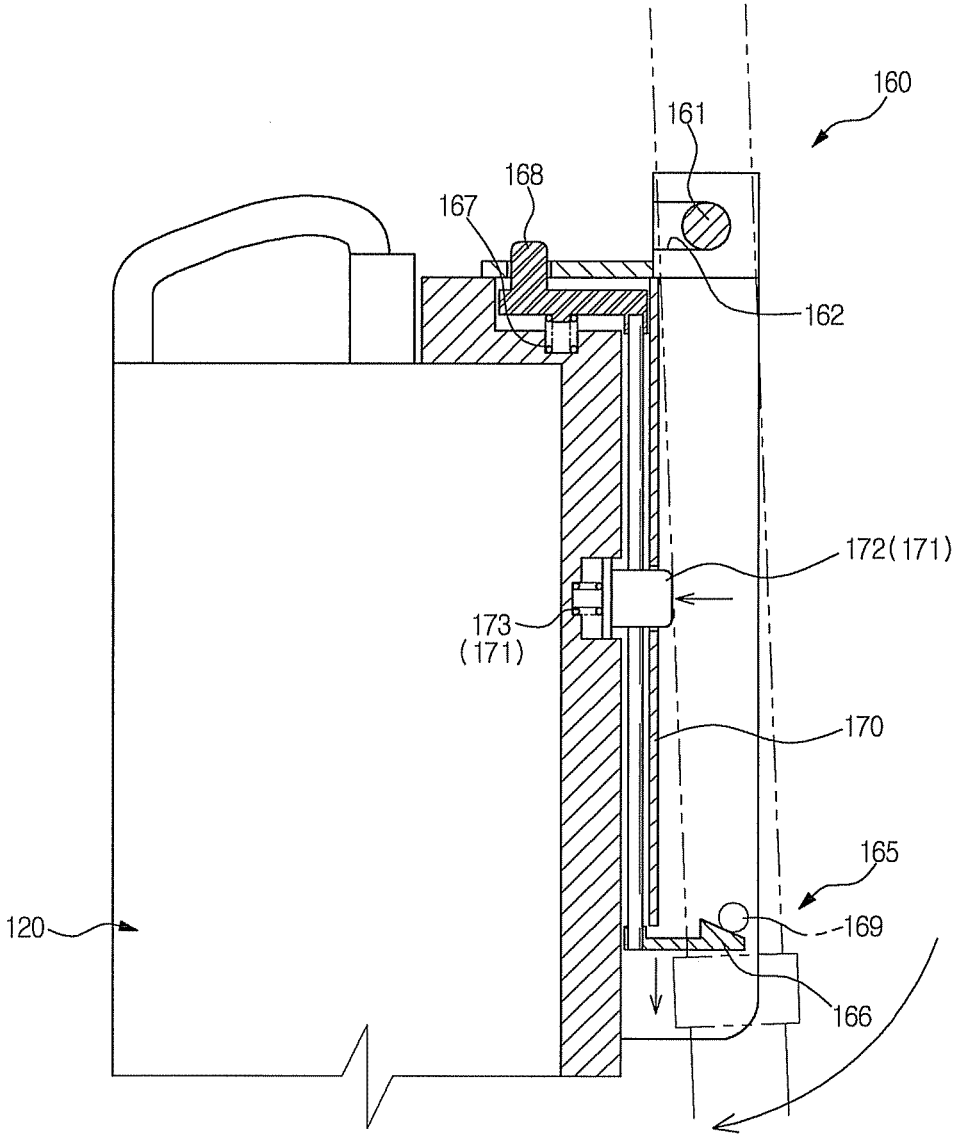
Figure 4:
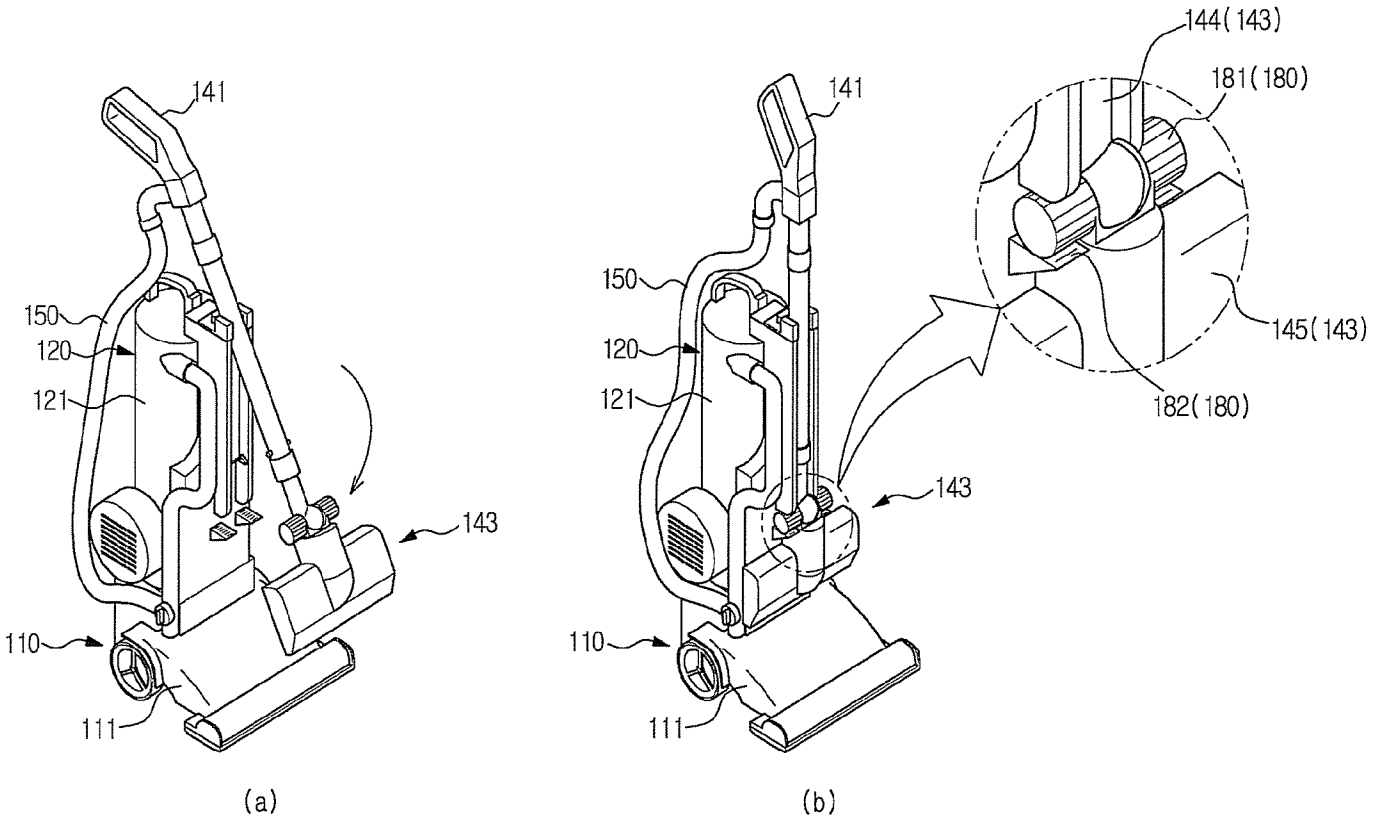
FIG. 4 parts (a) and (b) are perspective views illustrating the fixing of the suction device in accordance with an embodiment of the present invention to a main body.

FIGS. 2 and 3 are respectively exploded perspective and longitudinal-sectional views illustrating a fixing part of the suction device, in accordance with an embodiment of the present invention, and FIGS. 4A and 4B are perspective views illustrating the fixing of the suction device in accordance with an embodiment of the present invention to the main body. With reference to FIGS. 2 to 4B, the mounting structure of the suction device in accordance with an embodiment will be described.

As shown in FIGS. 2 to 4B, at least a portion of the suction device 130 in an embodiment is rotatably supported by the main body 120 on the condition that the tool 143 is mounted on the suction device 130, and thus the suction device 130 may be mounted on the main body 120, and the suction device 130 may be separated from the main body 120 on the condition that the tool 143 is mounted on the suction device 130.

Specifically, the upright type cleaner, in an embodiment, may include a rotating unit 160 provided on the suction device 130 and the main body 120 such that the suction device 130 is supported by the main body 120 and is rotated, a locking unit 165 provided on the wand assembly 140 and the main body 120 such that the wand assembly 140 rotated in one direction is locked with the main body 120, and an elastic support unit 171 elastically supporting the wand assembly 120 in a direction opposite to the locking direction.

The rotating unit 160 includes a rotary shaft 161 provided on the wand assembly 140, and a rotary groove 162 provided on the main body 120 and into which the rotary shaft 161 is inserted. In an embodiment, the rotary groove 162 of the main body 120 is preferably provided at the upper portion of the main body 120 such that a user can easily observe the position of the rotary groove 162. In another embodiment, the handle side of the wand assembly 140, e.g., a portion of the handle 141 or a portion of the pipe 142 being adjacent to the handle 141, is preferably supported rotatably by the main body 120.

The locking unit 165 may include, for example, a locking hook 166 provided on the main body 120, an elastic body 167 elastically supporting the locking hook 166 in one direction, a release button 168 formed integrally with the locking hook 166 to allow a user to press the locking hook 166 in a direction opposite to the elastically supporting direction of the locking hook 166, and a fastening part 169, to which the locking hook 166 may be fastened, provided on the wand assembly 140. A cover 170 covers the front surface of the main body 120.

The elastic support unit 171 includes a support body 172 contacting the wand assembly 140, and an elastic body 173 elastically supporting the support body 172.

By way of the above structure, when the rotary shaft 161 of the wand assembly 140 is inserted into the rotary groove 162 of the main body 120 and then the wand assembly 140 is rotated in a direction that causes the lower end of the wand assembly 140 to approach the main body 120, as shown in FIG. 3, the locking hook 166 moves in the opposite direction to the elastically supporting direction and is then returned to its original position. During this process, the fastening part 169 provided on the wand assembly 140 is fastened to the locking hook 166, and thus the wand assembly 140 is supported by the elastic support unit 171 and fixed to the main body 120.

On the other hand, when the release button 168 formed integrally with the locking hook 166 is pressed, the wand assembly 140 is released from the main body 120. The fastening between the locking hook 166 of the main body 120 and the fastening part 169 of the wand assembly 140 is released, and the wand assembly 140 is rotated in a direction opposite to the locking direction by the elastic force of the elastic support unit 171 and is released from the main body 120. Here, in an embodiment, the release button 168 is preferably located at the upper portion of the main body 120 such that a user of the suction device 130 may conveniently press the release button 168.

The upright type cleaner, in an embodiment, may further include an anti-rotating unit 180, which prevents the rotation of the housing 145 of the tool 143 when the suction device 130 is mounted on the main body 120.

The anti-rotating unit 180 may include, for example, protrusions 181 formed integrally with the housing 145 and protruding from both sides of the housing 145, and friction members 182 provided on the main body 120 and contacting the protrusions 181 (with reference to FIG. 4B) so that when the suction device 130 is mounted on the main body 120 rotation of the housing 145 is prevented. In an embodiment, surfaces of the friction members 182 and the protrusions 181, which contact each other, are made rough or uneven to increase the frictional force therebetween.

Although the cleaner in an embodiment may include protrusions formed integrally with the housing and contacting the friction members, the friction members may contact a portion of the housing to prevent the rotation of the housing. For example, the friction members may contact both ends of the housing and thus support the housing.

As described above, since the suction device 130 may be attached to the main body 120 on the condition that the tool 143 is mounted on the suction device 130, the upright type cleaner in an embodiment saves a user the trouble of attaching and detaching the tool 143 to and from the suction device 130 whenever the user wants to use the tool 143.

Particularly, in the uptight type cleaner in accordance with this embodiment, the suction device 130 can be stably attached to and detached from the main body 120 under the condition that the wide width type tool 142 is mounted on the suction device 130. Concretely, the suction device 130 of this embodiment is attached to and detached from the main body 120 in a rotating method, and thus the suction device 130 can be naturally attached to and detached from the main body 120 without the wide width type tool 143 interfering with the main body 120. Further, the suction device 130 of this embodiment can be stably connected to the main body 120 by the locking unit 165 even when a tool 143 having considerable size and weight is connected to the suction device 130.

Further, since the housing 145 of the tool 143 does not rotate even when a user uses the brush assembly 110 or moves the cleaner using the handle 141 when the suction device 130 is fixed to the main body 120, the upright type cleaner, in an embodiment, prevents the generation of noise or the breakage of the cleaner due to the rotation of the housing 145.

Figure 5:
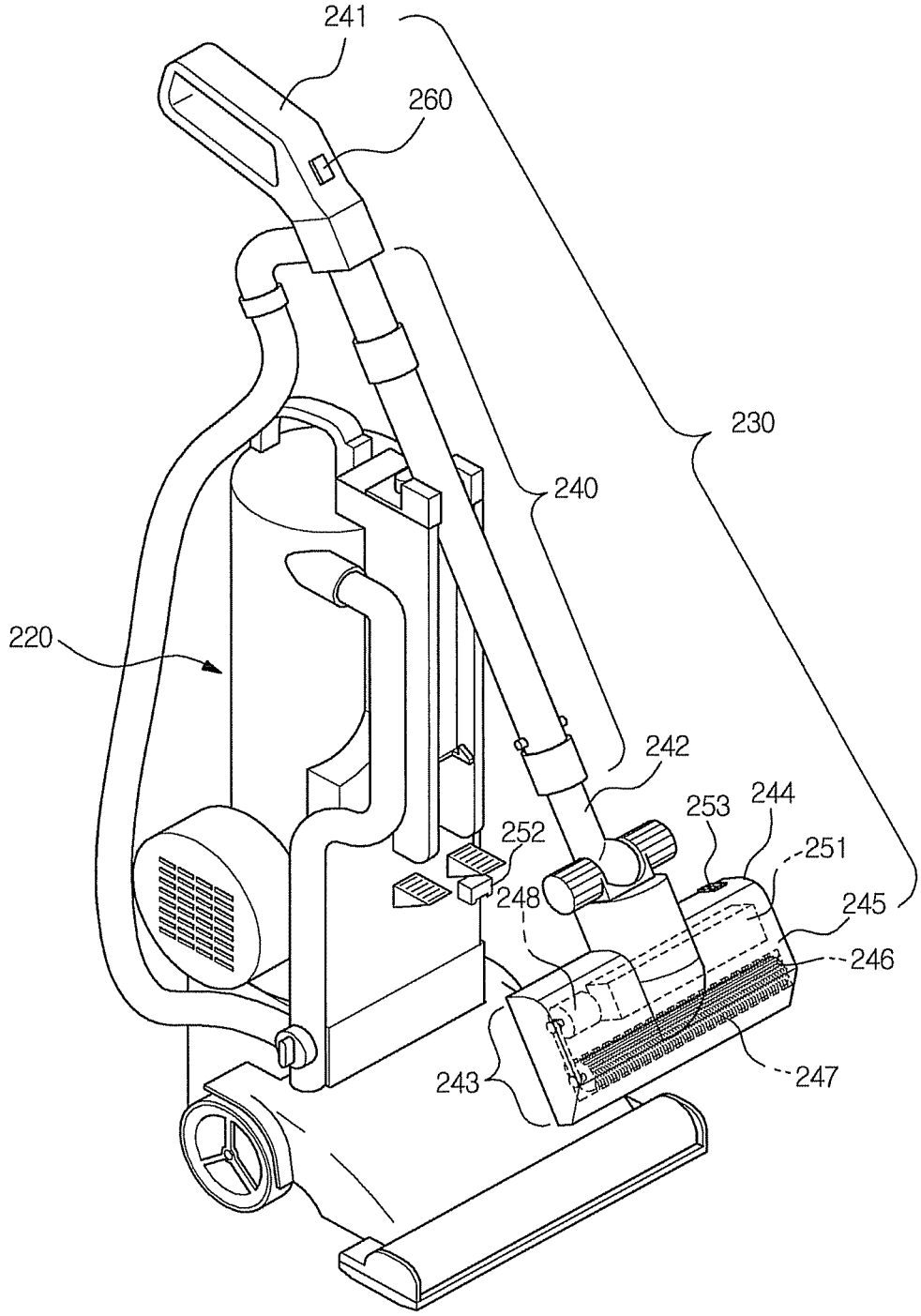
FIG. 5 is a perspective view illustrating the external appearance of an upright type cleaner in accordance with another embodiment of the present invention.

FIG. 5 is a perspective view illustrating the external appearance of an upright type cleaner in accordance with another embodiment of the present invention. Some parts in this embodiment, which are substantially the same as those in earlier embodiments, are denoted by the same reference numerals even though they are depicted in different drawings, and therefore a detailed description thereof will be omitted.

A tool 243 of the upright type cleaner, as shown in FIG. 5, includes a detachable part 244 connected to a pipe 242, a housing 245 rotatably connected to the detachable part 244 and provided with a suction port 246, a rotary brush 247 accommodated in the housing 245 and capable of being rotated, a driving motor 248 to drive the rotary brush 247, a power supply unit 251, including e.g., a battery, to supply power to electric parts including the driving motor 248, a first connection part 252 provided at one side of the housing 245 and electrically connected to the power supply unit 251, and a second connection part 253 provided on a main body 220 and electrically connected to the first connection part 252 of the electric tool 243 when a wand assembly 240 is locked with a main body 220.

Thereby, when the wand assembly 240 is locked with the main body 220, the power supply unit 251 is charged with power supplied from the main body 220, and thus it is possible to omit or reduce an electric wire provided in a suction device 230. Further, damage and wear and tear to the wire during use of the suction device 230 may be prevented.

Further, the upright type cleaner, in an embodiment, may further include a wireless control unit 260 provided on a handle 241 of the wand assembly 240 to wirelessly control the electric tool 243. A user may control the electric parts of the suction device 230 through the wireless control unit 260. Of course, the wireless control unit 260 may be disposed on other portions of the cleaner, such as the main body 220.

Figure 6:
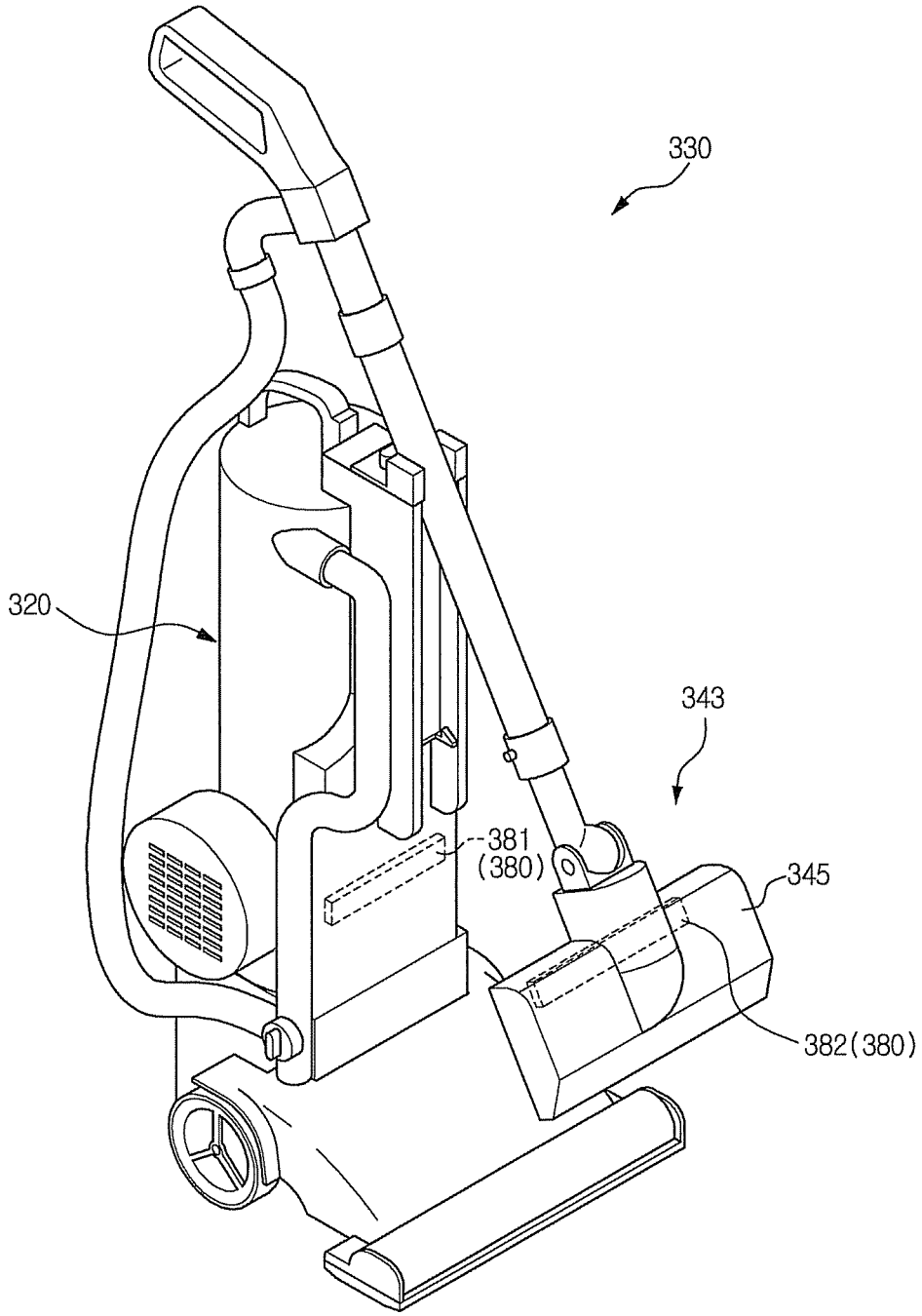
FIG. 6 is a perspective view illustrating the external appearance of an upright type cleaner in accordance with another embodiment of the present invention.

FIG. 6 is a perspective view illustrating the external appearance of an upright type cleaner in accordance with another embodiment of the present invention.

An anti-rotating unit 380 of the upright type cleaner in accordance with an embodiment may include, for example, a first adhesion part 381 provided on a main body 320, and a second adhesion part 382 provided on a housing 345 of a tool 343 and attached to the first adhesion part 381 of the main body 320 by e.g., magnetic force, when a suction device 330 is mounted on the main body 320. That is, the rotation of the housing 345 of the tool 343 when the suction device 330 is mounted on the main body 320 is prevented by the magnetic force applied between the first adhesion part 381 and the second adhesion part 382.

Figure 7:
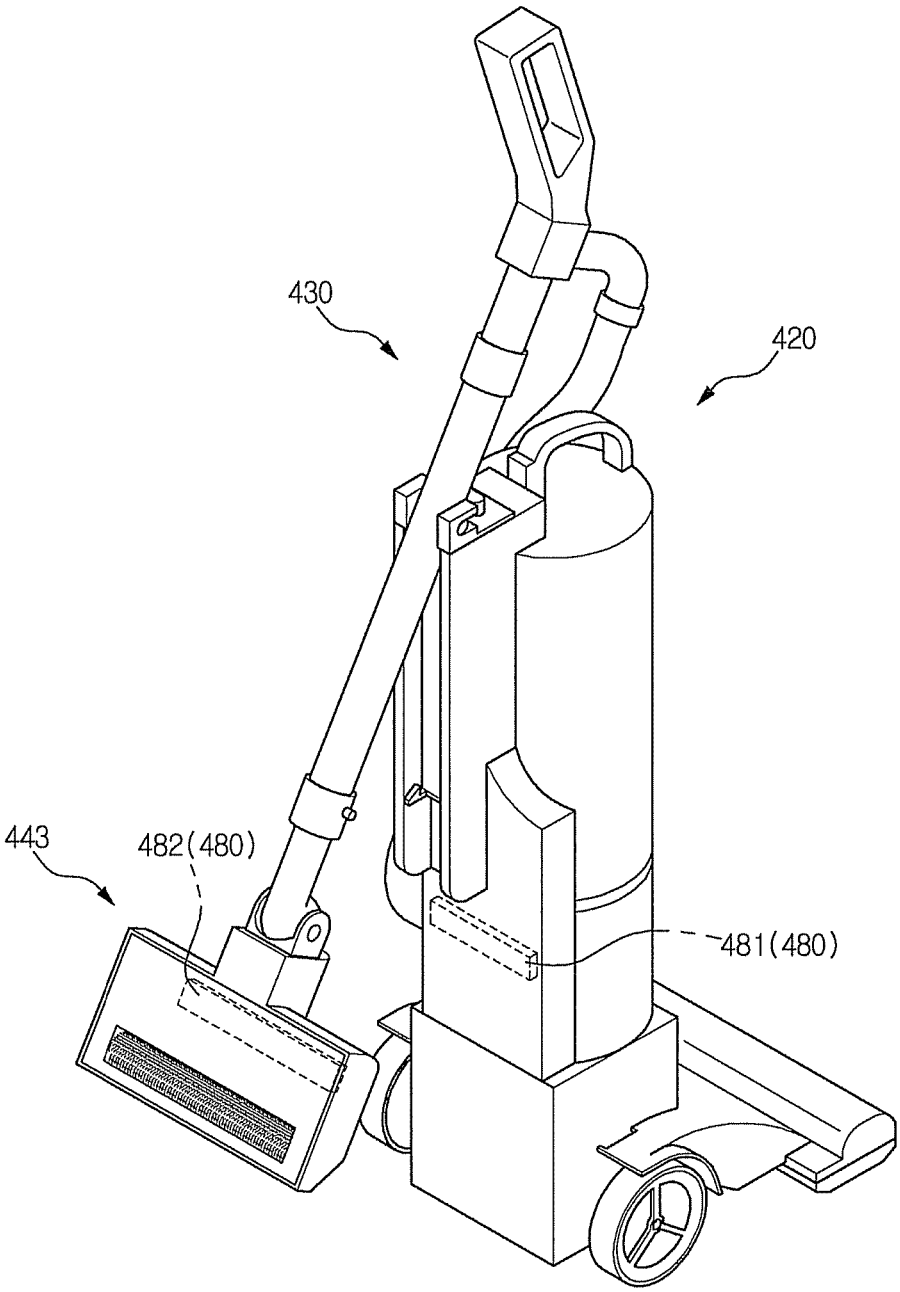
FIG. 7 is a perspective view illustrating the external appearance of an upright type cleaner in accordance with another embodiment of the present invention.

FIG. 7 is a perspective view illustrating the external appearance of an upright type cleaner in accordance with another embodiment of the present invention. A suction device 430 of the upright type cleaner in accordance with an embodiment may be detachably attached to the rear portion of a main body 420 when a tool 443 is mounted on the suction device 430.

Reference numerals 481 and 482 respectively represent first and second adhesion parts, which are provided on the main body 420 and a housing 445 of the tool 443 and are attached to each other by e.g., magnetic force. Thereby, the rotation of the housing 445 when the suction device 430 is mounted on the main body 420 may be prevented.

Figure 8:
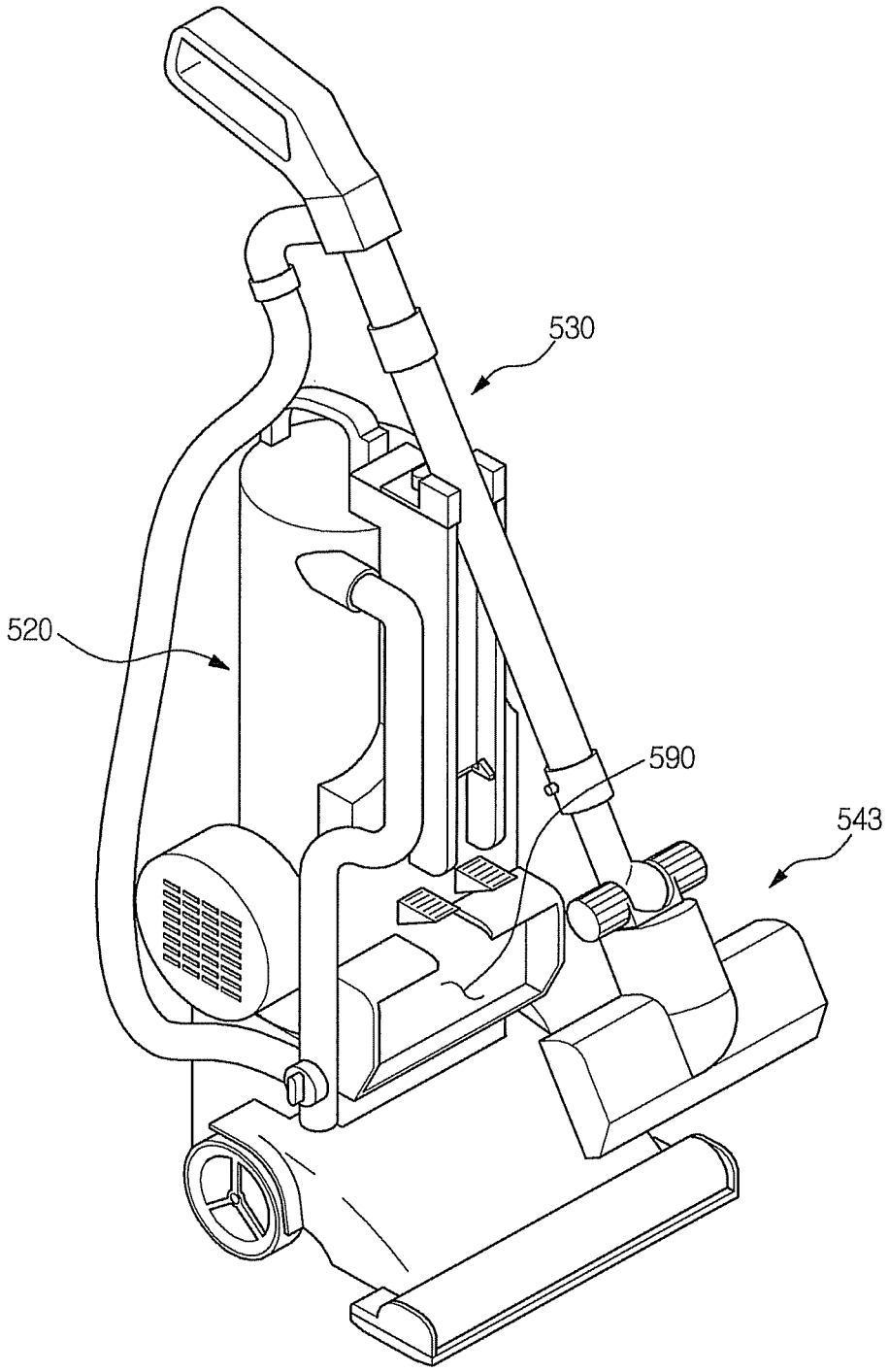
FIG. 8 is a perspective view illustrating an upright type cleaner in accordance with a fifth embodiment of the present invention.

FIG. 8 is a perspective view illustrating an upright type cleaner in accordance with a another embodiment of the present invention. The upright type cleaner in accordance with this embodiment further includes a tool receiving groove 590 provided on a main body 520 such that a tool 543 of a suction device 530 is received in the tool receiving groove 590. The tool receiving groove 590 is formed in a shape corresponding to the shape of the tool 543.

Thereby, in the upright type cleaner in accordance with this embodiment, in a case that the cleaner is moved under the condition that the suction device 530 is mounted on the main body 520, vibration and noise generated by the tool 543 are reduced. Further, the collision of the tool 543 with an external object is prevented, and thus damage to the tool 543 is prevented. Of course, the aesthetic effect of the cleaner is also improved.

The above-described embodiments of the invention are described only as examples, and it would be appreciated that various modifications may be made to these embodiments.

For example, the above-described rotating method is described as an example, and it would be appreciated that the suction device of embodiments of the present invention may be mounted on the main body by various methods on the condition that the tool is mounted on the suction device.

For example, the rotating unit may be located below the locking unit, and the wand assembly may be rotated in one direction on the condition that the lower portion of the wand assembly is rotatably supported by the main body, such that the upper portion of the wand assembly may be locked with the main body.

The rotary groove may be provided on the wand assembly, and the rotary shaft is provided on the main body. Further, the locking hook is provided on the wand assembly, and the fastening part may be provided on the main body. Moreover, although embodiments of the present invention illustrate that the locking hook is elastically supported, the fastening part may also be elastically supported.

Further, although embodiments of the present invention illustrate that the flexible hose to transmit the suction force of the suction fan to the suction device is extended from the main body, the flexible hose may alternatively be extended from the brush assembly.

As apparent from the above description, embodiments of the present invention provides a cleaner in which the mounting performance of a suction device is improved.

Although embodiments of the invention have been shown and described, it would be appreciated by those skilled in the art that changes may be made in these embodiments without departing from the principles and spirit of the invention, the scope of which is defined in the claims and their equivalents.

Further, the shape of the tool is not limited. For example, instead of the above-described wide width type tool, a tool having a narrow width, such as a clevis tool, may be mounted on the pipe of the suction device.

What is claimed is:

1. An upright type cleaner having a base provided with a suction port and a main body connected to the base, the cleaner comprising:

a suction device including a flexible hose extended from the base or the main body and a pipe connected to the flexible hose;

a detachable tool including a detachable part detachably connected to the pipe and a housing rotatably connected to the detachable part, wherein the suction device is attached to the main body using an attachment part provided on the detachable tool, wherein the suction device further includes a handle easily gripped by a user that is configured to serve as a handle of the main body when the suction device is attached to the main body using the attachment part.

2. The upright type cleaner according to claim 1, wherein, the tool further comprises an anti-rotating unit preventing the rotation of the tool when the suction device is mounted on the main body.

3. The upright type cleaner according to claim 2, wherein the anti-rotating unit includes friction members provided on the main body to apply frictional force to at least a portion of the housing of the tool.

4. The upright type cleaner according to claim 2, wherein:

the anti-rotating unit includes a first adhesion part provided on the main body, and a second adhesion part provided on the housing of the tool; and attraction due to magnetic force is applied between the first adhesion part and the second adhesion part when the suction device is mounted on the main body, thereby attaching the housing of the tool to the main body.

5. The upright type cleaner according to claim 1, wherein the tool is an electric tool.

6. The upright type cleaner according to claim 5, wherein the suction device further includes an electric wire and connection parts electrically connected to the electric tool to supply power to the electric tool when the electric tool is mounted on the suction device.

7. The upright type cleaner according to claim 5, further comprising a power supply unit provided on the electric tool to supply power to electric parts of the electric tool, a first connection part provided at one side of the electric tool and electrically connected to the power supply unit, and a second connection part provided on the main body to be electrically connected to the first connection part of the electric tool when the suction device is mounted on the main body, wherein the power supply unit is charged with power supplied from the main body when the suction device is mounted on the main body.

8. The upright type cleaner according to claim 5, further comprising a wireless control unit to control the electric tool by wireless, wherein the wireless control unit is provided on the handle of the suction device.

9. The upright type cleaner according to claim 1, wherein the suction device is rotated in one direction in a state supported by the main body, and thus is mounted on the main body.

10. The upright type cleaner according to claim 9, further comprising:

a rotary shaft provided on any one of the main body and the suction device; and a rotary groove, into which the rotary shaft is inserted, provided on the other one of the main body and the suction device.

11. The upright type cleaner according to claim 10, wherein the rotary shaft or the rotary groove provided on the main body is disposed at the upper portion of the main body.

12. The upright type cleaner according to claim 9, further comprising:

a locking hook provided on any one of the main body and the suction device; and a fastening part, to which the locking hook is fastened, provided on the other one of the main body and the suction device, wherein the locking hook or the fastening part is elastically supported.

13. The upright type cleaner according to claim 12, further comprising a release button releasing the fastening between the locking hook and the fastening part to release the suction device from the main body.

14. The upright type cleaner according to claim 1, wherein the width of the tool is wider than the width of the pipe of the suction device.

15. The upright type cleaner according to claim 14, further comprising a tool receiving groove provided on the main body to receive the tool of the suction device.

16. The upright type cleaner according to claim 1, wherein, the tool further comprises a suction port formed on the housing, a rotary brush accommodated within the housing and which rotates, and a driving motor to drive the rotating rotary brush.

17. The upright type cleaner according to claim 1, wherein the detachable tool must be attached to the pipe in order to attach the suction device to the main body using the attachment part.

18. An upright type cleaner comprising:

a brush assembly provided with a suction port;

a main body connected to the brush assembly; and a suction device including a detachable tool extended from the brush assembly or the main body, wherein the suction device is detachably mounted on the main body using an attachment part provided on the detachable tool, the detachable tool further comprising an anti-rotating unit preventing the rotation of the tool when the suction device is mounted on the main body, wherein the suction device further includes a handle that is configured to serve as a handle of the main body when the suction device is attached to the main body using the attachment part.

19. The upright type cleaner according to claim 18, wherein the suction device includes a flexible hose extended from the brush assembly or the main body, and a pipe connected to the flexible hose and provided with one end, on which the tool is mounted, wherein the width of the tool is wider than the width of the pipe of the suction device.

20. The upright type cleaner according to claim 18, further comprising a tool receiving groove provided on the main body to receive the tool of the suction device.

21. The upright type cleaner according to claim 18, wherein, the tool further comprises a suction port formed on a housing, a rotary brush accommodated within the housing and which rotates, and a driving motor to drive the rotating rotary brush.

22. The upright type cleaner according to claim 21, wherein the anti-rotating unit includes friction members provided on the main body to apply a frictional force to at least a portion of the housing of the tool.

23. The upright type cleaner according to claim 21, wherein:

the anti-rotating unit includes a first adhesion part provided on the main body, and a second adhesion part provided on the housing of the tool; and attraction due to magnetic force is applied between the first adhesion part and the second adhesion part when the suction device is mounted on the main body, thereby attaching the housing of the tool to the main body.

24. The upright type cleaner according to claim 18, wherein the detachable tool must be attached to the suction device in order to attach the suction device to the main body using the attachment part.

* * * * *